US005905427A

United States Patent [19]

Hamasaki et al.

[11] Patent Number: 5,905,427

[45] **Date of Patent: *May 18, 1999**

[54] INTEGRATED CIRCUIT RESISTOR ARRAY

[75] Inventors: Toshihiko Hamasaki, Yokohama; Hitoshi Terasawa, Tokyo; Toshio Murota; Keiji Matsuki, both of Kanagawa, all of Japan

[73] Assignee: Burr-Brown Corporation, Tucson, Ariz.

[ * ] Notice: This patent issued on a continued prosecution application filed under 37 CFR 1.53(d), and is subject to the twenty year patent term provisions of 35 U.S.C. 154(a)(2).

[21] Appl. No.: 08/719,452

[22] Filed: Sep. 25, 1996

[30] Foreign Application Priority Data

Sep. 29, 1995 [JP] Japan ..... 7-253639

[51] Int. Cl.[6] ..... H01C 1/01

[52] U.S. Cl. ..... 338/320; 338/260; 338/295; 338/288; 338/289

[58] Field of Search ..... 338/235, 239, 338/295, 260, 320, 288, 289; 341/153

[56] References Cited

U.S. PATENT DOCUMENTS

| | | | |
|---|---|---|---|
| 3,692,987 | 9/1972 | Bos | 364/579 |
| 4,242,660 | 12/1980 | Cocca | 338/195 |
| 4,484,178 | 11/1984 | Lovgren et al. | 341/153 |
| 4,646,056 | 2/1987 | Brokaw | 338/195 |
| 4,703,302 | 10/1987 | Hino et al. | 338/293 |
| 4,804,940 | 2/1989 | Takigawa et al. | 341/133 |
| 4,816,830 | 3/1989 | Cooper | 341/153 |
| 5,206,623 | 4/1993 | Rochette et al. | 338/203 |
| 5,319,345 | 6/1994 | Abe et al. | 338/201 |
| 5,351,030 | 9/1994 | Kobayashi et al. | 338/295 |
| 5,554,986 | 9/1996 | Neidorff | 341/153 |

FOREIGN PATENT DOCUMENTS

| | | | |
|---|---|---|---|
| 2039154 | 7/1980 | United Kingdom | 338/320 |

OTHER PUBLICATIONS

Bross et al., "Modular Resistor Array", IBM TDB V. 13, No. 5, (Oct. 1970) (US CL 338/195).

Data Sheet for the PCM1710U Dual Voltage Output CMOS Delta–sigma DAC with On–chip Filter, Burr–Brown Japan, Ltd., Apr. 1994, pp. 1–16.

Two sheets showing a top view and analog circuit design of the relevant portion of the PCM1710 product acknowledged to be prior art on p. 2 of the specification. No date noted by examiner but still considered as admission.

*Primary Examiner*—Renee S. Luebke
*Assistant Examiner*—Karl Easthom
*Attorney, Agent, or Firm*—Cahill, Sutton & Thomas P.L.C.

[57] ABSTRACT

An integrated circuit resistor array suitable for use as resistors included in a high performance analog integrated circuit is provided. A plurality of resistor stripes are collectively arranged in a region on a substrate. The resistor stripes are made of the same material and designed to have the same cross-sectional area. The resistor stripes are electrically connected through first metal layer conductors. Second metal layer conductors connect the stripes to external circuits. Different resistors have matched voltage dependencies.

13 Claims, 10 Drawing Sheets

EQUIVALENT CIRCUIT OF SUMMING AMPLIFIER 3

EQUIVALENT CIRCUIT OF SUMMING AMPLIFIER 3

EQUIVALENT CIRCUIT OF SUMMING AMPLIFIER 3

Voltage Coefficient of Poly-Silicon Resistor

INTEGRATED CIRCUIT RESISTOR ARRAY

BACKGROUND OF THE INVENTION

1. Field of the Invention

The present invention relates generally to an integrated circuit resistor array used for providing a number of resistors within an analog integrated circuit which may affect the voltage dependency of a predetermined parameter such as a gain of the analog integrated circuit, and more particularly to a resistor array which is suitable for use as a number of such resistors within an analog integrated circuit requiring high performance, such as a summing amplifier in a digital-to-analog converter.

2. Description of Related Art

A conventional oversampling multi-bit digital-to-analog converter (DAC), for example, model PCM1710 DAC manufactured by the assignee of the present application, generally includes a noise shaping circuit for oversampling a digital input, a plurality of CMOS inverters the outputs of which are switched to high or low in response to a multi-bit digital modulated output from the noise shaping circuit, and a summing amplifier for combining outputs from the inverters to generate an analog output. The summing amplifier comprises a plurality of converting resistors (i.e., unit weighting resistors having a uniform weight) each having one of the terminals thereof connected to the output of a corresponding inverter, a CR filter connected to the other terminals of the converting resistors opposite to those connected to the inverter outputs, and a differential instrumentation amplifier connected to the output of the CR filter.

The integrated circuit of the model PCM1710 DAC includes within the summing amplifier a first group of resistors including the converting resistors as well as filter resistors in the CR filter and a second group of resistors including input resistors and feedback resistors in the instrumentation amplifier. The first and second groups of resistors are provided by poly-silicon resistors which are located in suitable positions near their associated circuits and thus in first and second regions spaced apart from each other. It should be noted that "poly-silicon resistors" referred to in this disclosure include not only resistors made of poly-silicon material only but also resistors having a polyside structure. The term "polyside" is commonly used to refer to a stacked film layer consisting of a polycrystalline silicon layer and a metal layer.

Each poly-silicon resistor in each of the first and second regions is constituted by a stripe arranged in a comb shape. The comb shape stripe consists of a plurality of elongated tooth-like poly-silicon stripe portions and a plurality of short connecting poly-silicon stripe portions each of which connects one of the ends of a tooth-like stripe portion to one of the ends of an adjacent tooth-like stripe portion. The connecting stripe portions extend in the direction orthogonal to the tooth-like stripe portion. The tooth-like stripe portions and connecting stripe portions in each of the first and second regions have the same thickness, width and length. Also, the tooth-like stripe portions in the first region are positioned orthogonal to those in the second region. In the structure mentioned above, since a required resistance of a resistor is determined by a total length of the comb shaped stripe formed by a serial connection of adjacent tooth-like stripe portions made by connecting stripe portions, resistors having different resistances may be realized in the same region by serially connecting different numbers of tooth-like stripe portions through connecting stripe portions.

The above-mentioned poly-silicon resistors are advantageous over metal thin-film resistors made of silicon chrome, nichrome or the like from a viewpoint of process contamination and process adaptability in the sub-micron integrated circuit technology. However, the poly-silicon resistor has a problem that its voltage dependency (or voltage coefficient) is higher as compared with the metal thin-film resistor. Also, the poly-silicon resistor has a characteristic such that its voltage coefficient is smaller as its width is narrower with the same thickness, i.e., as its cross-sectional area is smaller.

Further, the integrated circuit process techniques, particularly, the etching of poly-silicon or the like has a problem that the etching rate depends on etched location, etching direction and etched area on a chip. Thus, even if a poly-silicon material is to be etched to form poly-silicon resistors having the same width in different locations, in different directions, or over different etched areas, poly-silicon resistors having different widths may result, whereby the poly-silicon resistors would present different voltage dependencies. As a result, parameters of the summing amplifier, for example, a gain, would have a voltage dependency which is dependent upon the voltage dependencies of the poly-silicon resistors. In view of the characteristics of the whole DAC, this would adversely affect analog characteristics of the DAC such as linearity, dynamic range, and so on.

The above-mentioned problem may apply not only to an analog integrated circuit such as a summing amplifier in a DAC but also to analog integrated circuits within other devices.

SUMMARY OF THE INVENTION

It is therefore an object of the present invention to provide an integrated circuit resistor array which is suitable for use as resistors for a high-performance analog integrated circuit.

It is another object of the present invention to provide an integrated circuit resistor array which is used to minimize the voltage dependency of a predetermined parameter, such as a gain, of an analog integrated circuit.

It is a further object of the present invention to provide a summing amplifier for a digital-to-analog converter which employs the above-mentioned integrated circuit resistor array.

The above objects are achieved by the present invention which provides an integrated circuit resistor array for use in an analog integrated circuit formed on an integrated circuit substrate, wherein said resistor array constitutes a plurality of resistors in said analog circuit, said plurality of resistors affecting a voltage dependency of a predetermined parameter of said analog integrated circuit, said resistor array comprising: a plurality of spaced resistor elements being collectively arranged in a single region on said substrate, said resistor elements including a plurality of stripes made of the same material and having the same cross-sectional area; and electrical conductor means for forming said plurality of resistors by electrically connecting said plurality of resistor elements.

According to the present invention, the plurality of stripes may have the same width, may be closely spaced from each other in the single region, and may be arranged to extend in the same direction and in parallel with each other. Also, the electrical conductor means connects at least two of the resistor elements to form each of the plurality of resistors. Further, each of the plurality of resistor elements may have a resistance value lower than the resistance value of the smallest resistor within the plurality of resistors.

Also, according to the present invention, the plurality of resistors may include a plurality of resistor groups, wherein each of the resistor groups comprises a plurality of resistors having resistance values to be matched with each other. Then, each of the resistor groups may comprise adjacent resistor elements being positioned in one of the areas in the single region. In addition, the one area may comprise a plurality of adjacent subareas, and the electrical conductor means may form each of a plurality of resistors in the each resistor group using at least one resistor element selected from a plurality of resistor elements in each of the plurality of subareas in the one area. Alternatively, it is also possible that the single area is a first area comprising a plurality of subareas including non-contiguous subareas, and the electrical conductor means forms each of the plurality of resistors in the each resistor group using at least one resistor element selected from a plurality of resistor elements in each of the plurality of subareas in the first area. Then, the plurality of resistors may include first and second resistor groups which are to be matched in resistance, a second area, which is another said one area different from the first area, may include at least one subarea which is positioned between two said non-contiguous subareas in the first area, and the first resistor group is formed in the first area, while the second resistor group is formed in the second area.

According to the present invention, the resistor elements may comprise poly-silicon resistors or diffusion resistors. The analog integrated circuit may be a circuit which includes at least one operational amplifier. Further, the predetermined parameter may be a gain of the analog integrated circuit.

Also, the above objects are achieved by a summing amplifier according to the present invention which comprises a plurality of weighting resistors, and an operational amplifier including at least one input resistor and at least one feedback resistor, wherein the plurality of weighting resistors, the at least one input resistor and the at least one feedback resistor are formed by the integrated circuit resistor array mentioned above.

According to the present invention, the summing amplifier may include a CR filter having filter resistor means, and the filter resistor means may be also formed by the integrated circuit resistor array. Also, the summing amplifier may be used in an oversampling digital-to-analog converter.

BRIEF DESCRIPTION OF THE DRAWINGS

The present invention will hereinafter be described in connection with preferred embodiments thereof with reference to the accompanying drawings.

DESCRIPTION OF THE PREFERRED EMBODIMENTS

It should be first noted that in the following description, an integrated circuit resistor array according to the present invention will be discussed which is used, by way of example, in a summing amplifier within an oversampling multi-bit digital-to-analog converter (DAC) for audio equipment.

Figure 1:
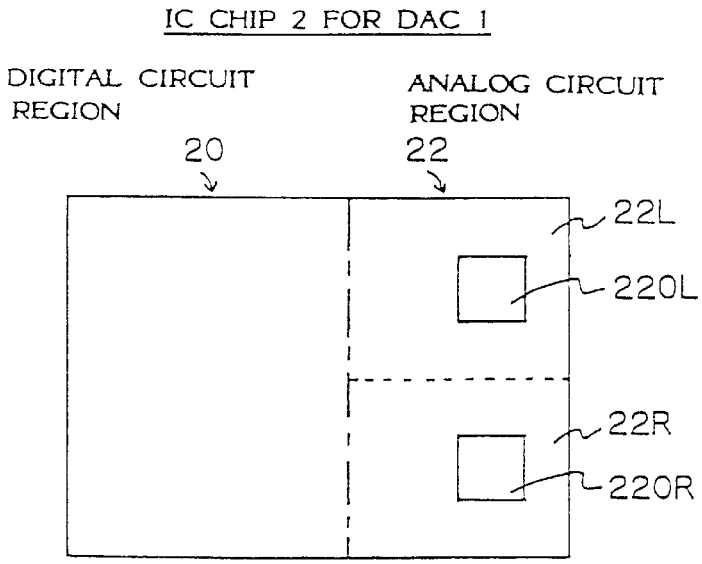
FIG. 1 is a top plan view showing the circuit arrangement of an oversampling digital-to-analog converter (DAC) on an IC chip, wherein the locations of integrated circuit resistor arrays according to the present invention are shown.
Figure 2:
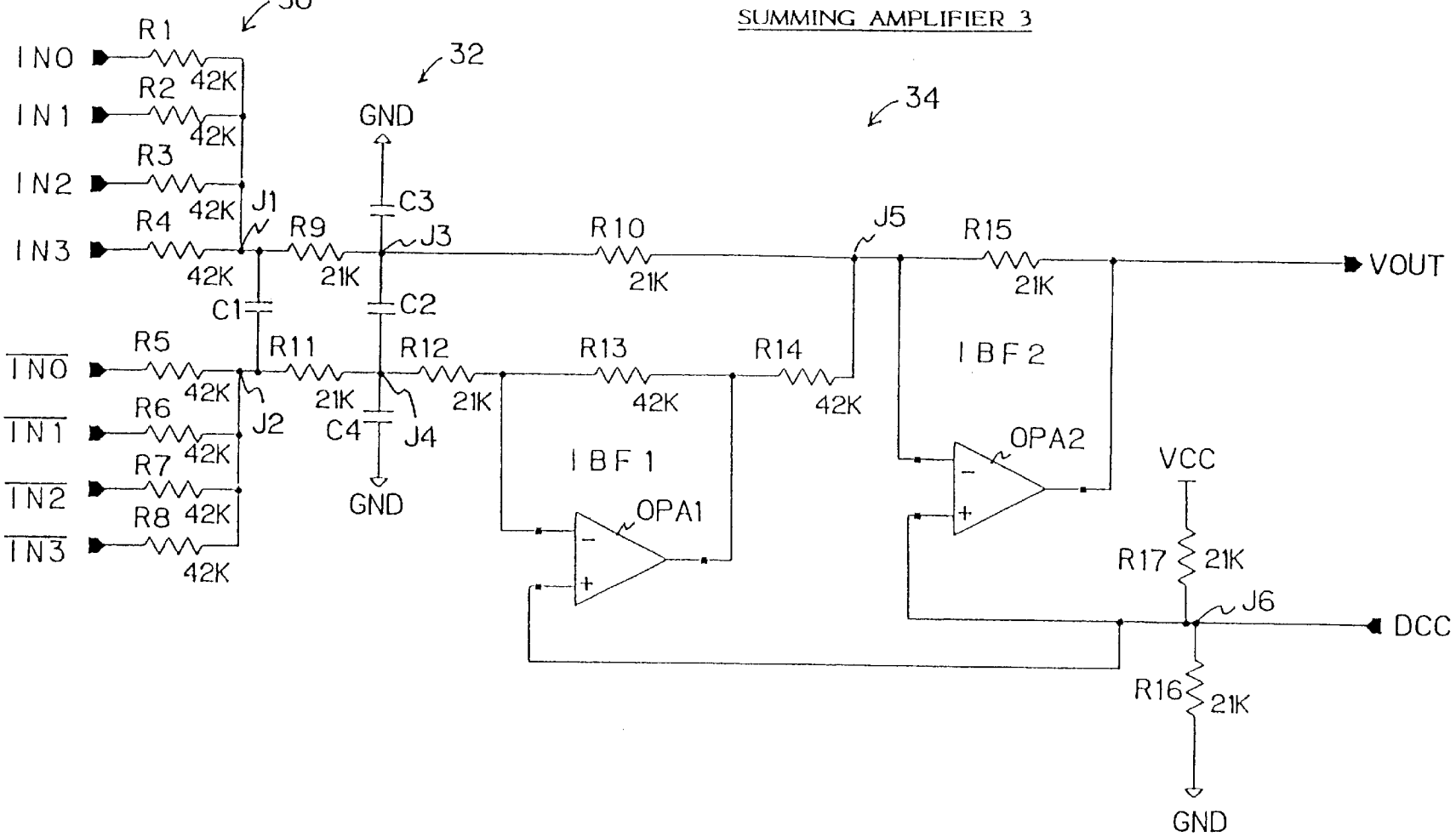
FIG. 2 is a schematic diagram of a summing amplifier included in the DAC shown in FIG. 1, which uses a resistor array according to the present invention.
Figure 3:
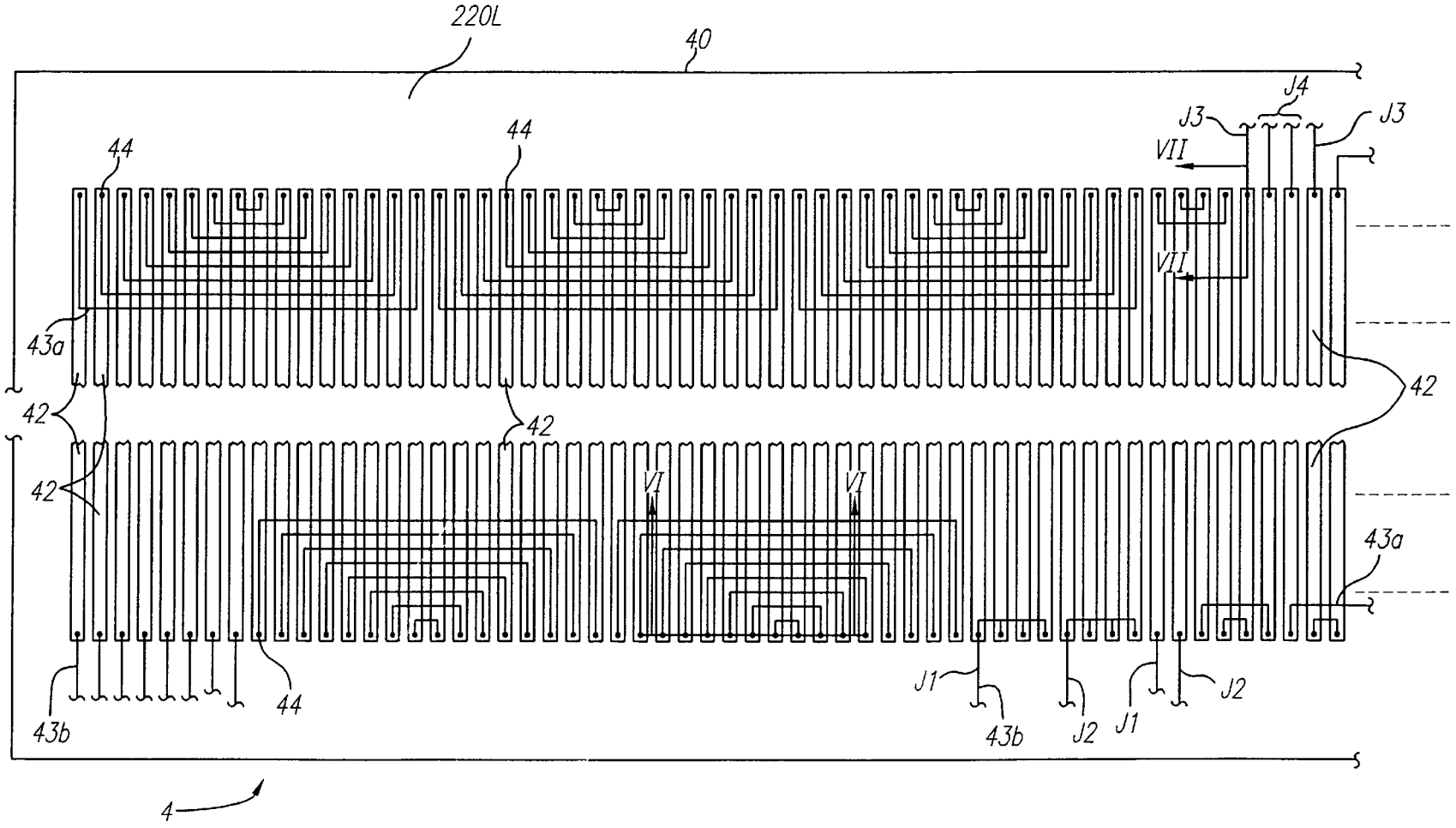
FIG. 3 is a top plan view showing the layout of an embodiment of an integrated circuit resistor array according to the present invention which is used in the summing amplifier shown in FIG. 2.

Referring first to FIGS. 1–3, the above-mentioned oversampling digital-to-analog converter (DAC) 1 has a circuit arrangement shown in FIG. 1 on an IC chip 2 for the converter. DAC 1 includes a summing amplifier 3 a schematic diagram of which is partly shown in FIG. 2. Summing amplifier 3 uses an integrated circuit resistor array 4 the layout of which is shown in FIG. 3 in a plan view.

As shown in FIG. 1, the IC chip 2 implementing the DAC 1 includes a digital circuit region 20 and an analog circuit region 22. Analog circuit region 22 is divided into an L-channel (Ch) circuit region 22L and an R-channel (Ch) circuit region 22R. Each of the regions 22L and 22R includes a substantially square-shaped resistor array region 220L or 220R (the dimension of each square region is approximately 200$\mu$m×200$\mu$m) in which an integrated circuit resistor array 4 according to the present invention is provided. A summing amplifier 3 including an array 4 is positioned in each of the regions 22L and 22R.

Referring next to FIG. 2, the summing amplifier 3 generally comprises a converting resistor circuit 30, a CR filter circuit 32 and a differential buffer circuit 34. Since the DAC 1 is of a differential type, the converting resistor circuit 30 includes four converting resistors R1–R4 on a non-inverting side each having one end connected to receive a corresponding one of outputs IN0–IN3 from four CMOS inverters (not shown) on the non-inverting side, and four converting resistors R5–R8 on an inverting side each having one end connected to receive a corresponding one of outputs $\overline{IN0}$–$\overline{IN3}$ from four CMOS inverters (not shown) on the inverting side. All of the converting resistors R1–R8 have the same resistance value, e.g., 42 KΩ in order to provide uniform unit weightings. The resistors R1–R4 on the non-inverting side have the other ends thereof being connected to a junction J1, while the resistors R5–R8 on the inverting side have the other ends thereof being connected to a junction J2.

The CR filter circuit 32 comprises capacitors C1–C4 and resistors R9 and R11. Capacitor C1 is connected between the junctions J1 and J2 so as to constitute a differential low pass filter in combination with the resistors R1–R8. Resistor R9 and capacitor C3 are connected in series between the junction J1 and ground GND so as to constitute a low pass filter. Resistor R11 and capacitor C4 are connected in series between the junction J2 and ground GND and constitutes a low pass filter. Capacitor C2 is connected between a junction J3 (a junction between the resistor R9 and the capacitor C3) and a junction J4 (a junction between the resistor R11 and the capacitor C4) such that the capacitor C2 constitutes a differential low pass filter in combination with the resistors R9 and R11. Resistors R9 and R11 have a resistance value of 21 KΩ. Capacitors C1 and C2 have a capacitance of 47.4 pF. Capacitors C3 and C4 have a capacitance of 4.74 pF.

Differential buffer circuit 34 comprises first and second inverting buffers IBF1 and IBF2. The first inverting buffer IBF1 comprises an operational amplifier OPA1, an input resistor R12 connected between an inverting input terminal of the amplifier OPA1 and the junction J4, a feedback resistor R13 connected between the inverting input terminal and an output terminal of the amplifier OPA1, and an output resistor R14 connected between the output terminal of the amplifier OPA1 and a junction J5. A non-inverting input terminal of the operational amplifier OPA1 is connected to a junction J6 between resistors R16 and R17. The resistor R17 has the other end thereof being connected to a power supply terminal VCC, while the resistor R16 has the other end thereof being connected to ground GND. The junction J6 is connected to a terminal which is provided for connection to the non-inverting input terminals of the operational amplifiers. The second inverting buffer IBF2 comprises an operational amplifier OPA2 having its inverting input terminal connected to the junction J5 and its non-inverting input terminal connected to the junction J6, an input resistor R10 connected between the junctions J3 and J5, and a feedback resistor R15 connected between the inverting input terminal and an output terminal of the amplifier OPA2. The operational amplifier OPA2 has its output terminal connected to a voltage output terminal VOUT of the summing amplifier 3. The resistors R10, R12 and R15–R17 have a resistance value of 21 kΩ. R13 and R14 have a resistance value of 42 kΩ. VCC is set to 5 volts.

Figure 13A:
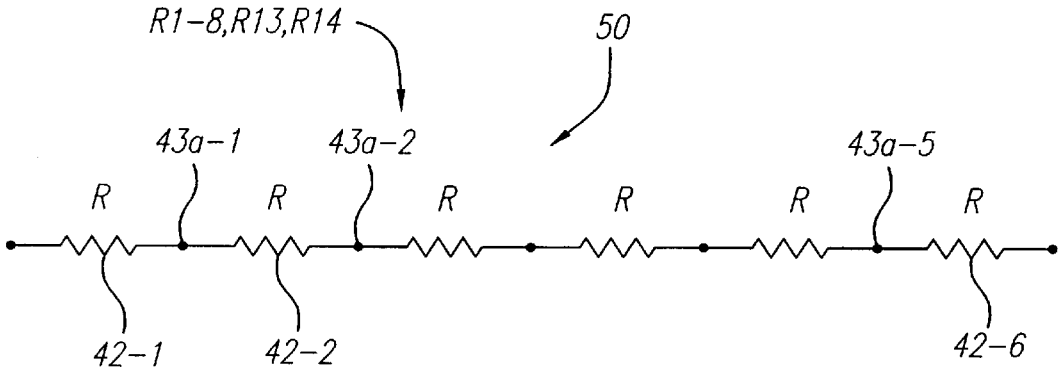
FIG. 13A is a schematic diagram useful in explaining how the 42 KΩresistors are implemented for FIGS. 3 and 8.

FIG. 13A shows how each of the 42 KΩ resistors R1–R8 and R13 and R14 in FIG. 2 are implemented by connecting six equal-resistance stripes 41-1,2 . . . 6 in series by means of interconnecting metal conductors 43*a*-1,2 . . . 5 to provide a resistor 50 as shown. As subsequently explained, for each of resistors R1 through R8, each of the resistive stripes 42-1,2 . . . 6 is located in a separate subregion such as A1S1,2,3 . . . 6 in FIG. 8. For each of resistors R13 and R14, each of the resistive stripes, each of resistance R equal to 7 KΩ, is in a separate subregion such as A4S1,2 . . . 6 of FIG. 8. FIG. 3 also shows the location of the identical resistive stripes 42 and the metal conductors 43*a* interconnecting them.

Figure 13B:
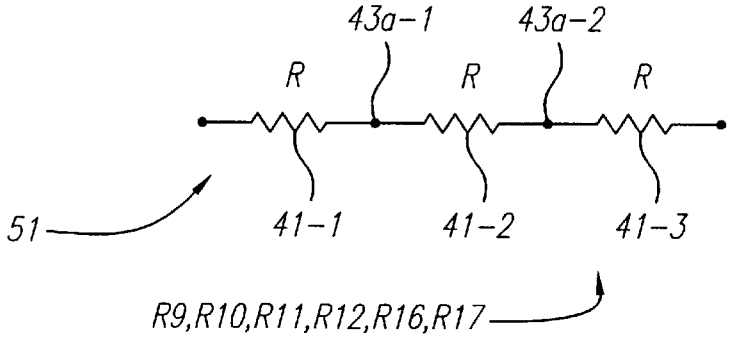
FIG. 13B is a schematic diagram useful in explaining how most of the 21 KΩ resistors in FIG. 2 are implemented for FIGS. 3 and 8.

FIG. 13B shows how each of the 21 KΩ resistors R9, R10, R11, R12, R16, and R17 in FIG. 2 are implemented, by connecting three resistive stripes 42-1, 42-2 and 42-3 in series by means of metal conductors 43*a*-1 and 43*a*-2, as shown. Each of the 7 KΩ resistive stripes 42 lies in a different subarea of a corresponding subregion of a corresponding resistor being completely formed within one of the subregions A2,3,4,5.

Figure 13C:
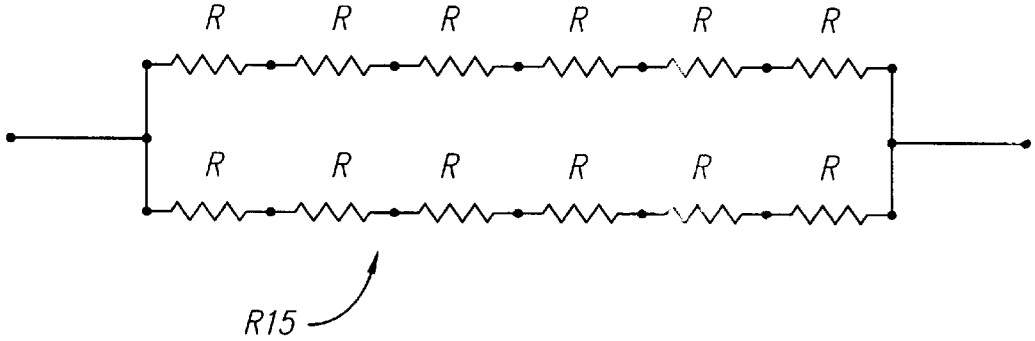
FIG. 13C is a schematic diagram showing how one 21 K Ω resistor in FIG. 2 is implemented.

FIG. 13C shows how the 21 KΩ resistor R15 is composed of two 42 KΩ resistors of FIG. 13A connected in parallel.

Figure 4A:
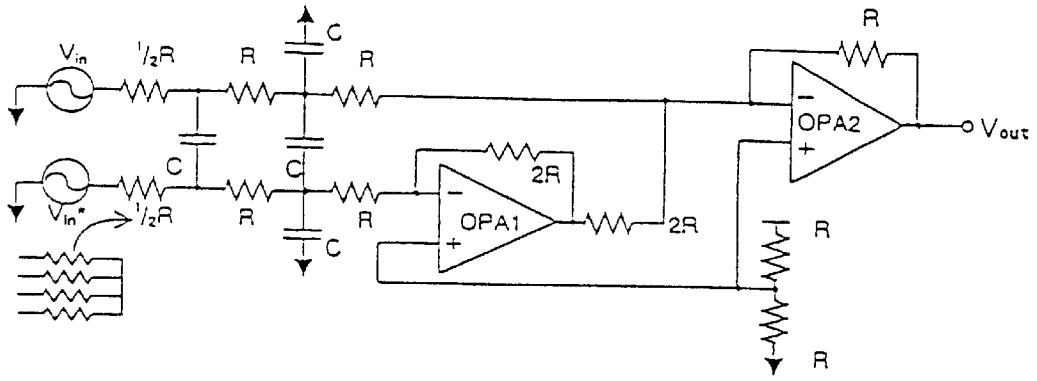
FIGS. 4A, 4B and 4C are schematic diagrams showing equivalent circuits of the summing amplifier shown in FIG. 2 which are simplified in the order of 4A, 4B, 4C, paying attention to resistors included in the circuit.
Figure 4B:
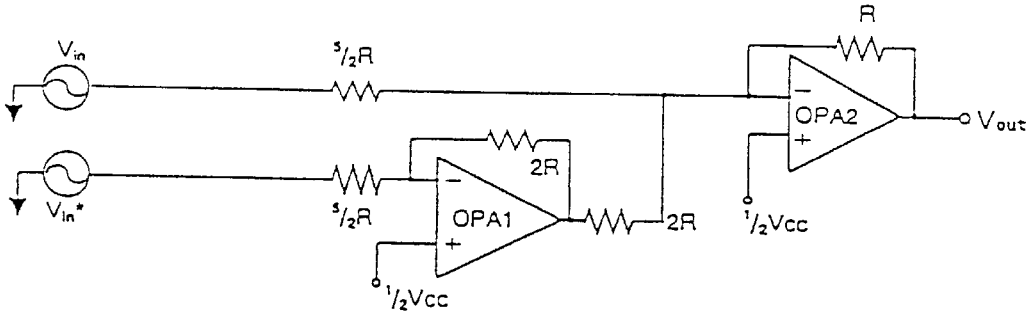
Figure 4C:
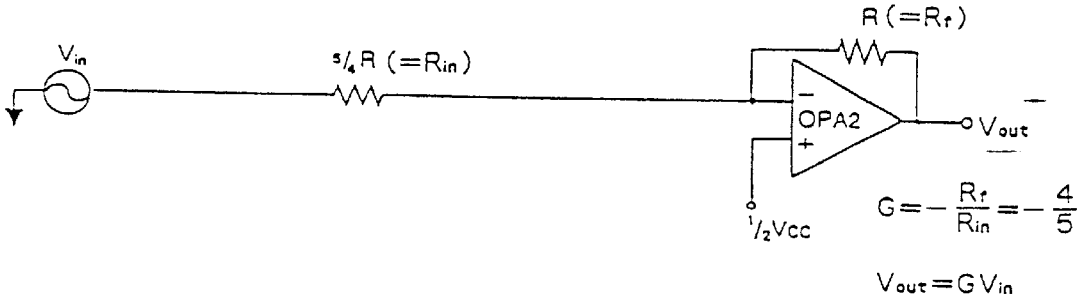

FIGS. 4A, 4B and 4C show equivalent circuits of the summing amplifier 3 shown in FIG. 2, which are simplified in the order of 4A-4B-4C, paying attention to the resistances included in the summing amplifier 3. Referring specifically to the drawings, Vin is a voltage source collectively representing the inverter outputs IN0–IN3, and Vin* is a voltage source collectively representing the inverter outputs $\overline{IN0}$–$\overline{IN3}$. R is a unit resistance of 21 KΩwhich is used to represent the resistors R1–R17. As can be seen from FIG. 4A, since the set of resistors R1–R4 and the set of resistors R5–R8 each comprises a parallelly connected four 2R resistors, the total resistance value of each of the resistor sets is equal to (1/2)R. Also, in FIG. 4B, the non-inverting side circuit including the source Vin supplies a current (2/5R)Vin to the inverting input terminal of the operational amplifier OPA2, while the inverting side circuit including the source Vin* and the first inverting buffer IBF1 supplies a current −(2/5R)Vin* to the inverting input of the amplifier OPA2, resulting in (2/5R)Vin−(2/5R)Vin*=(4/5R)Vin. Thus, an input circuit to the inverting input terminal of the operational amplifier OPA2 may be equivalent to a series connection of Vin and (5/4)R, as shown in FIG. 4C.

As will be understood from FIG. 4C, assuming that an input resistance is Rin and a feedback resistance is Rf, a voltage gain G of the summing amplifier 3 is given by G=−Rf/Rin. Substituting the above values into this equation, the gain G will be equal to −R/{(5/4)R}=−4/5. Thus, an analog output voltage is theoretically expressed by Vout=−(4/5)Vin. However, if Rin and Rf are implemented by poly-silicon resistors, they would actually have respective significant voltage dependencies. Therefore, matching of the voltage dependencies between Rin and Rf is critical in order to minimize the voltage dependency of the gain G of the summing amplifier 3 and hence improve analog characteristics of the DAC 1.

Figure 5:
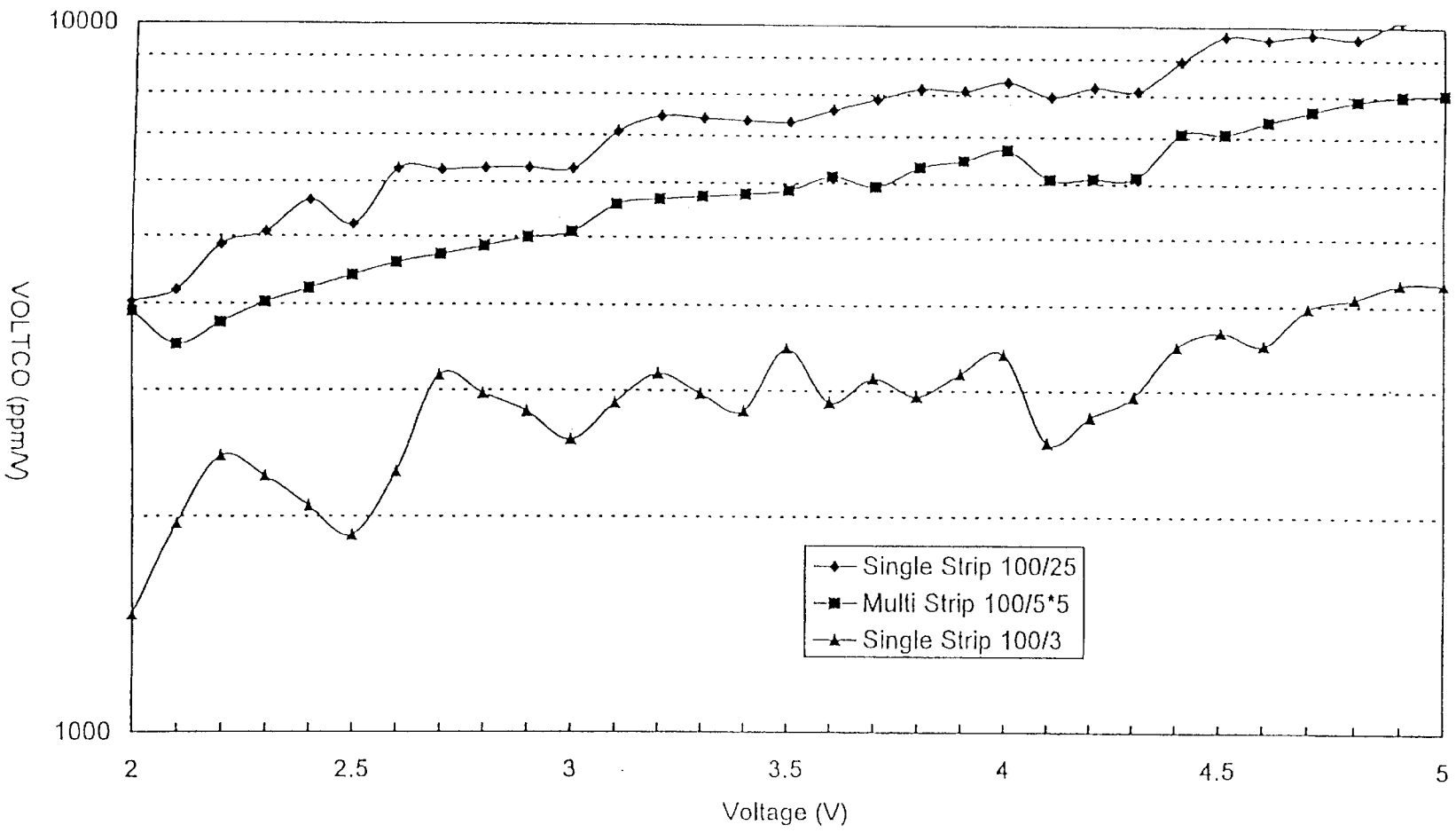
FIG. 5 is a graph showing the voltage dependency of poly-silicon resistors, wherein the abscissa axis represents the magnitude of a voltage applied across a poly-silicon resistor, and the ordinate axis (logarithmic scale) represents a voltage coefficient VOLTCO (ppm/V) of the resistance of the poly-silicon resistor.

FIG. 5 is a graph showing the voltage dependencies of poly-silicon resistors, where the abscissa axis represents the magnitude of a voltage applied across a poly-silicon resistor, and the ordinate axis (represented by a logarithmic scale) represents a voltage coefficient VOLTCO (ppm/V) of the resistance value of the poly-silicon resistor. A curve connecting diamond-like marks indicates the characteristic of a single stripe having a width of 25 μm and a length of 100 μm; a curve connecting rectangular marks indicates the characteristic of a multiple stripe form including a parallel connection of five stripes each having a width of 5 μm and a length of 100 μm; and a curve connecting triangular marks indicates the characteristic of a single stripe having a width of 3 μm and a length of 100 μm . It should be noted that the respective stripes have the same thickness of approximately 5000 angstroms. As is understood from the graph of FIG. 5, the voltage coefficient of the poly-silicon resistor increases as a larger voltage is applied thereto, and the voltage coefficient decreases as the width of the poly-silicon resistor is narrower, i.e., as the cross-sectional area thereof is smaller. From this fact, when a number of poly-silicon resistors are used, they should be formed in a width (or cross-sectional area) as uniform as possible and they should be applied with a voltage as uniform as possible, for maximally matching their voltage coefficients with each other.

The present invention provides a circuit arrangement to minimize the voltage dependency of the gain G of the summing amplifier 3 shown in FIG. 2. More specifically, the equivalent input resistance Rin and the feedback resistance Rf of the operational amplifier OPA2 are made in a ratio of 5/4 to 1, as mentioned above, such that substantially the same magnitude of voltage is always applied across the equivalent input resistance Rin connected between the voltage source Vin and a virtual ground and across the feedback resistance Rf connected between the virtual ground and the output voltage. In addition, the integrated circuit resistor array shown in FIG. 3 is used as resistors for the summing amplifier 3.

Figure 6:
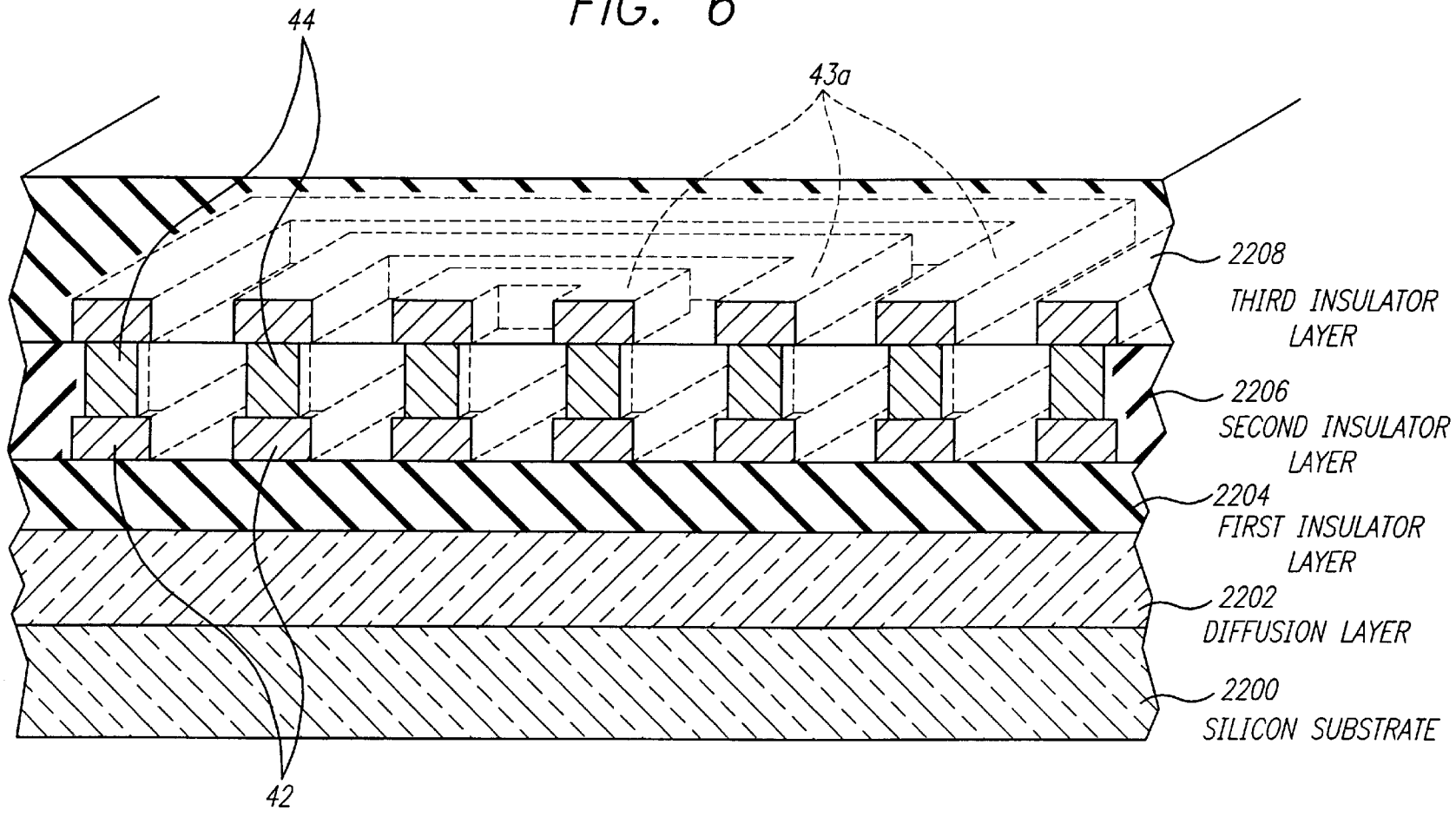
FIG. 6 is a cross-sectional view taken along line VI—VI in FIG. 3, partially including a perspective view.
Figure 7:
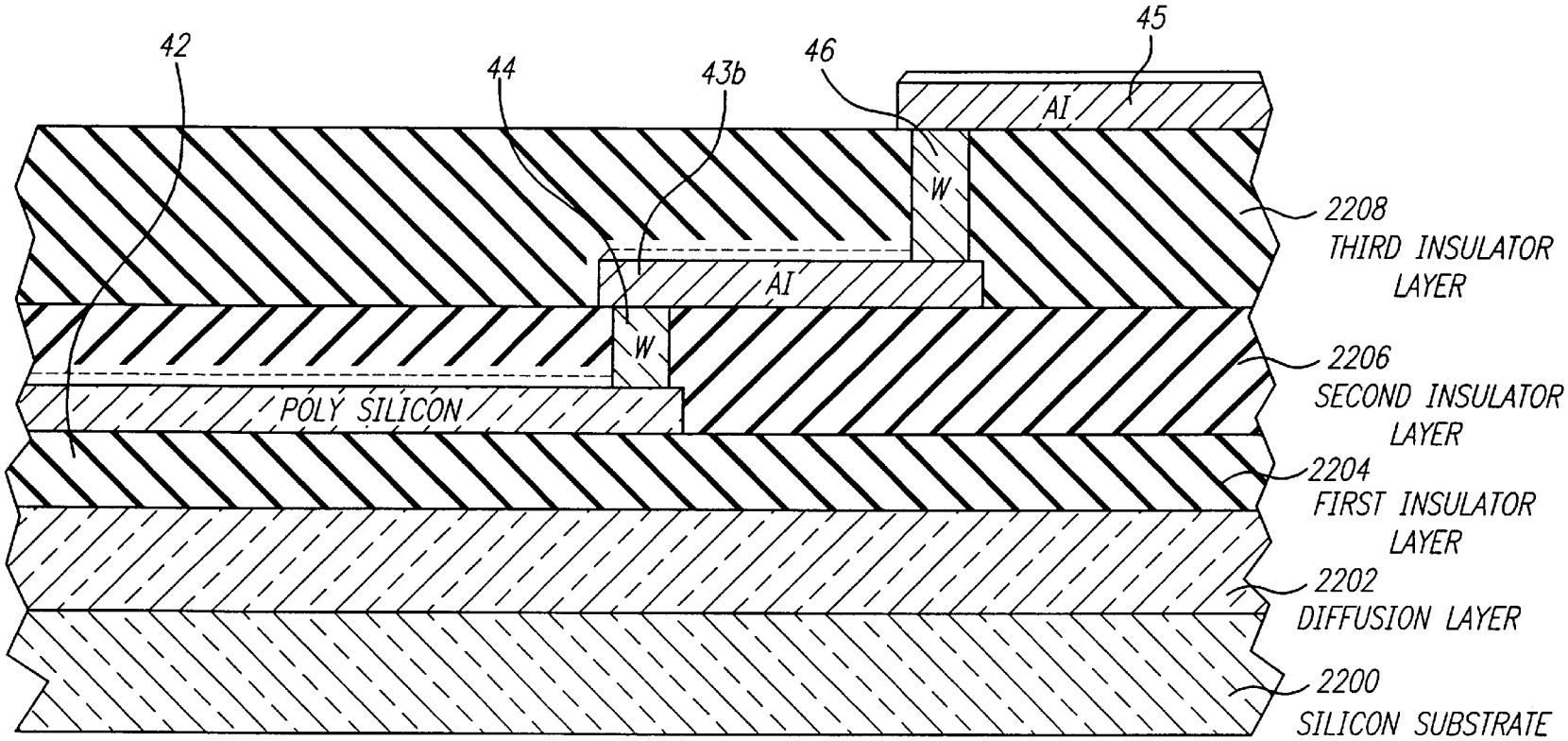
FIG. 7 is a cross-sectional view taken along line VII—VII in FIG. 3, partially including a perspective view.

Next, with reference to FIGS. 3, 6 and 7, the integrated circuit resistor array 4 will be described hereinafter. FIG. 6 shows a cross-sectional view taken along line VI—VI in FIG. 3, and FIG. 7 shows a cross-sectional view taken along line VII—VII in FIG. 3. The shown resistor array 4 is arranged in one of the array regions 220L and 220R in FIG. 1, for example, the substantially square region 220L. First, the horizontal structure of the array 4 will be described. As can be seen from FIGS. 3 and 6, an N+ active region 41 in an N-well region 40 includes a hundred linear poly-silicon layer stripes 42 extending in parallel with each other (two stripes on the respective ends are not used). Also, as shown in FIG. 6, the array 4 includes first metal layer conductors 43*a* made of aluminum and having substantially a U-shaped plane form, and contacts 44 comprising tungsten plugs each for connecting an end of a first metal layer conductor 43*a* to an end of a corresponding stripe 42, such that stripes 42 are interconnected. Also, as shown in FIG. 7, the array 4 includes second metal layer conductors 45 made of aluminum and vias 46 comprising tungsten plugs each for connecting an end of a second metal layer conductor 45 and an end of a first metal layer conductor 43*b*, such that stripes 42 are connected to external circuits, specifically, to outputs IN0–IN3 and $\overline{\text{IN0}}$–$\overline{\text{IN3}}$, junctions J1–J4, terminal DCC, the output terminals and inverting input terminals of the operational amplifiers OPA1 and OPA2, and the bias terminals of the amplifiers OPA1 and OPA2, terminal VCC and ground terminal GND. The other end of the metal layer conductor 43*b* is connected to an end of a stripe 42 through a contact 44.

All of the stripes 42 are designed to have the same width (for example, 1.4 μm), the same length (for example 200 μm) and the same thickness (for example, 1500angstroms), i.e., to have the same cross-sectional area. Also, the stripes 42 are designed to be spaced at regular intervals (for example, 0.6 μm) from respective adjacent stripes. In the drawings, the stripes are designated symbols "R1"–"R17", respectively, to show which stripes are used for each of the resistors R1–R17 within the circuit shown in FIG. 2. Each stripe has a resistance value of 7 kΩ. Thus, the resistors R1–R8, R13 and R14, each having a resistance value of 42 kΩ, employ six stripes connected in series, while the resistors R9–R12, R16 and R17, each having a resistance value of 21 KΩ, employ three stripes connected in series. The resistor R15 having a resistance value of 21 KΩ employs 12 stripes, where two sets of series connected six stripes (each set having a resistance value of 42 KΩ) are connected in parallel. In addition, six stripes from the right end of the array 4 are used for an internal resistor R1(OPA1) of the operational amplifier OPA1 and for an internal resistor R1(OPA2) of the operational amplifier OPA2, though not shown in the circuit shown in FIG. 2.

Next, the vertical structure of the array 4 will be described with reference to FIGS. 6 and 7. The array 4 includes, from the bottom, a silicon substrate 2200 of the IC chip 2, a diffusion layer 2202 defining the N-well 40, a first insulator layer 2204, a second insulator layer 2206 in which the poly-silicon layer 42 and the contacts 44 are embedded, a third insulator layer 2208 in which the first metal layers 43*a* and 43*b* and the vias 46 are embedded, and the second metal layer 45 deposited on the third insulator layer 2208.

Figure 8:
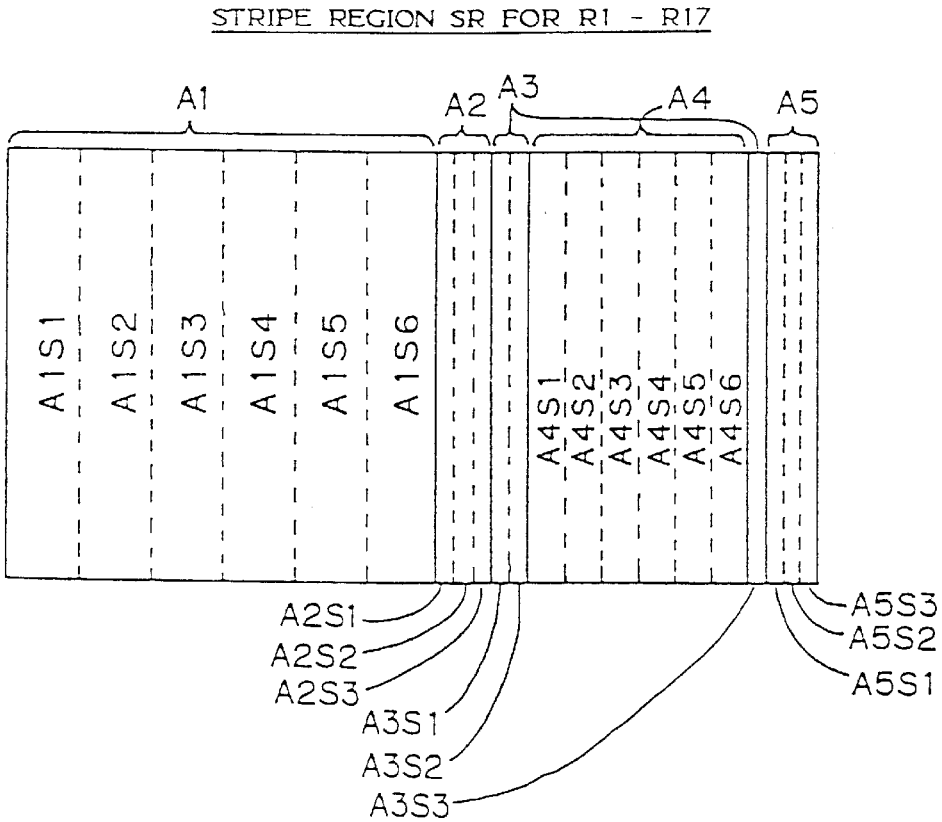
FIG. 8 is a diagram showing how a stripe region SR including 90 stripes for resistors R1–R17 in FIG. 3 is divided into a plurality of areas and subareas.

Referring now to FIG. 8, how to average variations in resistances and voltage coefficients among the stripes in the resistor array 4 of the summing amplifier 3 will be described.

First, as can be seen also from the circuit arrangement of the summing amplifier 3 shown in FIG. 2, there are the following several groups of resistors wherein the resistances and voltage coefficients of the resistors in each of the groups should especially match with each other:

- a group RG1 of converting resistors R1–R8;
- a group RG2 of filter resistors R9 and R11;
- a group RG3 of input resistors R10 and R12 for the operational amplifiers;
- a group RG4 of feedback and output resistors R13–R15 for the operational amplifiers;
- a group RG5 of resistors R10 and R12–R15 for the operational amplifiers; and
- a group RG6 of resistors R16 and R17.

Then, a region SR including a total of 90 stripes 42 for the resistors R1–R17 in FIG. 3 is divided into the following areas, as shown in FIG. 8:

- an area A1 for the resistor group RG1 (R1–R8);
- an area A2 for the resistor group RG2 (R9, R11);
- a separated area A3 for the resistor group RG3 (R10, R12);
- an area A4 for the resistor group RG4 (R13–R15); and
- an area A5 for the resistor group RG6 (R16, R17). Further, the area A1 is divided into six adjacent subareas A1S1–A1S6, where each of the subareas include eight adjacent stripes with one stripe in each of the subareas being assigned to each of the resistors R1–R8. The stripes in the subareas assigned to each of the resistors R1–R8 are connected in series to constitute the respective resistors R1–R8. In this way, the influence due to variations of individual stripes is minimized by the averaging.

Similarly, the area A2 is divided into three adjacent subareas A2S1–A2S3, wherein two stripes are included in each of the subareas, such that stripes respectively comprising a stripe in each of the respective subareas are connected in series to constitute each of the resistors R9 and R11. The area A3 is made up of two adjacent subareas A3S1 and A3S2 and a non-contiguous subarea A3S3 remote from the subareas A3S1 and A3S2, where two stripes are included in each subarea. Stripes respectively comprising a stripe in each of the respective subareas A3S1–A3S3 are connected in series to form each of the resistors R10 and R12. The area A4 is positioned within the area A3 and divided into six adjacent subareas A4S1–A4S6, where four stripes are included in each subarea. Stripes respectively comprising a stripe in each of the respective subareas A4S1–A4S6 are connected in series to form each of the resistors R13 and R14. In addition, sets of two parallel connected stripes which respectively comprise two stripes in each of the respective subareas A4S1–A4S6 are connected in series to form R15. The area A4 is positioned in the area A3 in order to increase the degree of matching of the resistors in the resistor group RG5. Also, by using a larger number of stripes for R15 (functioning as the feedback resistor Rf in FIG. 4C), the matching of R15 with an equivalent input resistor comprising the other resistors R1–R14 (corresponding to the equivalent input resistor Rin shown in FIG. 4C) is improved. Finally, the area A5 is divided into three adjacent subareas A5S1–A5S3, wherein two stripes are included in the respective subareas. Stripes respectively comprising a stripe in each of the respective subareas A5S1–A5S3 are connected in series to form each of the resistors R16 and R17.

In the summing amplifier 3 having the resistor array 4 as described above, the voltage dependency of the voltage gain is reduced, whereby the DAC 1 using the summing amplifier 3 exhibits a significant improvement in the dynamic range thereof, as compared with conventional DACs of the same type. As an example, the dynamic range is improved from 92 dB (conventional) to 96 dB (the present invention), thus presenting an increase of 4 dB. It can be said that the 4 dB is considered to be quite large as an improvement near 100 dB.

Next, with reference to FIGS. 9A–12, a variety of modifications to the foregoing embodiment will be described.

Figure 9A:
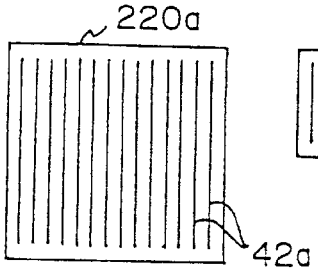
FIGS. 9A–9D are plan views illustrating modifications of the outline of the region in which a resistor array is arranged.
Figure 9B:
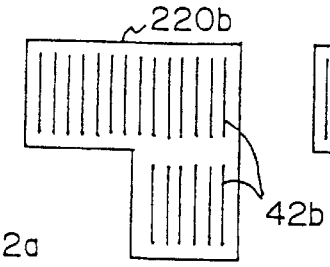
Figure 9C:
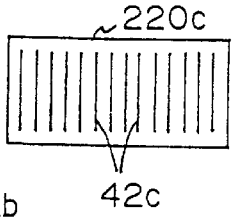
Figure 9D:
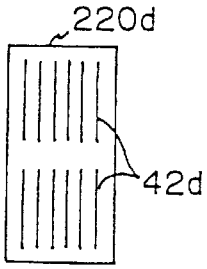

Referring first to FIGS. 9A–9D, the shape of the region in which the resistor array 4 is provided may be modified as required by a particular circuit design. While the foregoing embodiment has employed a region 220*a* substantially square in shape as shown in FIG. 9A, other regions, for example, an L-shaped region 220*b*, a horizontally elongated rectangular region 220*c* and a vertically elongated rectangular region 220*d* shown in FIGS. 9B, 9C and 9D may also be used, whereby resistor stripes such as the stripes 42 may be collectively placed in such a region. It should be noted that in the examples shown in FIGS. 9A–9D, groups of resistor stripes 42*a*, 42*b*, 42*c* and 42*d* are arranged such that the stripes in each of the groups extend in the same direction and have the same aspect ratio (ratio of length to width). Even with such a modified shape of the stripe region, the present invention provides advantages similar to those of the foregoing embodiment.

Figure 10A:
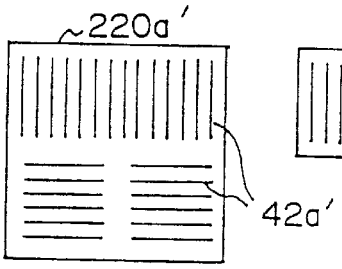
FIGS. 10A–10C are plan views illustrating modifications of the resistor array wherein stripes in a region extend in two or more different directions.
Figure 10B:
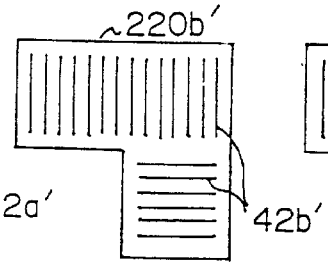
Figure 10C:
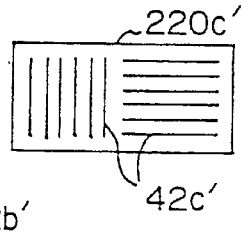

FIGS. 10A–10C show, by way of example, modifications wherein stripes arranged in one and the same region extend in two or more different directions. It should be noted that the stripes in the same region have the same aspect ratio. Specifically, in FIG. 10A, a square region 220*a*' has a stripe group 42*a*' which comprises a group of stripes extending in the vertical direction and two groups of stripes extending in the horizontal direction. An L-shaped region 220*b*' in FIG. 10B has a stripe group 42*b*' which comprises a group of stripes extending in the vertical direction and a group of stripes extending in the horizontal direction. In a rectangular region 220*c*' shown in FIG. 10C, a stripe group 42*c*' is similar to the stripe group shown in FIG. 10B except that a reduced number of stripes are provided in the vertical direction. Even with the modifications mentioned above, similar advantages to those of the foregoing embodiment are provided except for a particular advantage provided by arranging all stripes to extend in the same direction (i.e., a contribution to unifying stripe widths).

Figure 11A:
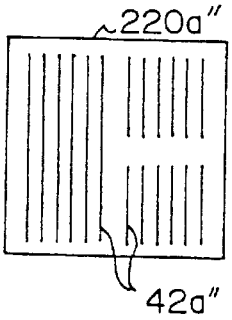
FIGS. 11A–11C are plan views illustrating modifications of the resistor array wherein stripes extending in non-identical directions are provided in two or more different aspect ratios.
Figure 11B:
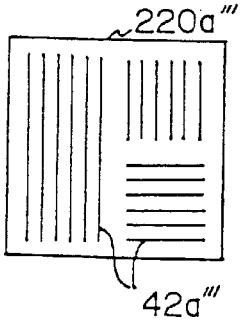
Figure 11C:
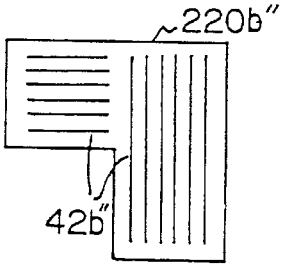

FIGS. 11A–11C show other modifications wherein stripes arranged in respective regions have two or more different aspect ratios (however, the width is fixed), in addition to the modifications made in FIGS. 10A–10C, i.e., different extending directions. More specifically, a stripe group 42*a*" in a square region 220*a*" shown in FIG. 11A includes three groups of stripes extending in the vertical directions, wherein stripes in one of the three groups have a larger aspect ratio or a larger length than the remaining two groups. A stripe group 42*a*'" in a square region 220*a*'" in FIG. 11B differs from the square region 220*a*" in FIG. 11A in that two groups of stripes having a smaller aspect ratio extend in two different directions, i.e., in the vertical direction and in the horizontal direction, respectively. In a stripe group 42*b*" in an L-shaped region 220*b*" in FIG. 1C, a group of stripes extending in the horizontal direction have an aspect ratio smaller than that of a group of stripes extending in the vertical direction. Even with modifications as mentioned above, similar advantages as those provided by the foregoing embodiment are provided except for particular advantages provided by the same extending direction of all stripes and by the same aspect ratio of all stripes (i.e., contributions to unifying stripe widths).

While the foregoing embodiment has been described in connection with a resistor array having poly-silicon resistors used as resistor stripes, the present invention is not limited to this particular type of resistors; other types of integrated circuit resistors or integrated circuit resistors made of other materials, having voltage dependency, for example, diffusion resistors, may also be used. In addition, further types of integrated circuit resistors or integrated circuit resistors made of other different materials, the resistances of which have voltage coefficients related to the cross-sectional area of stripes, may also be used in the resistor array of the present invention.

Figure 12:
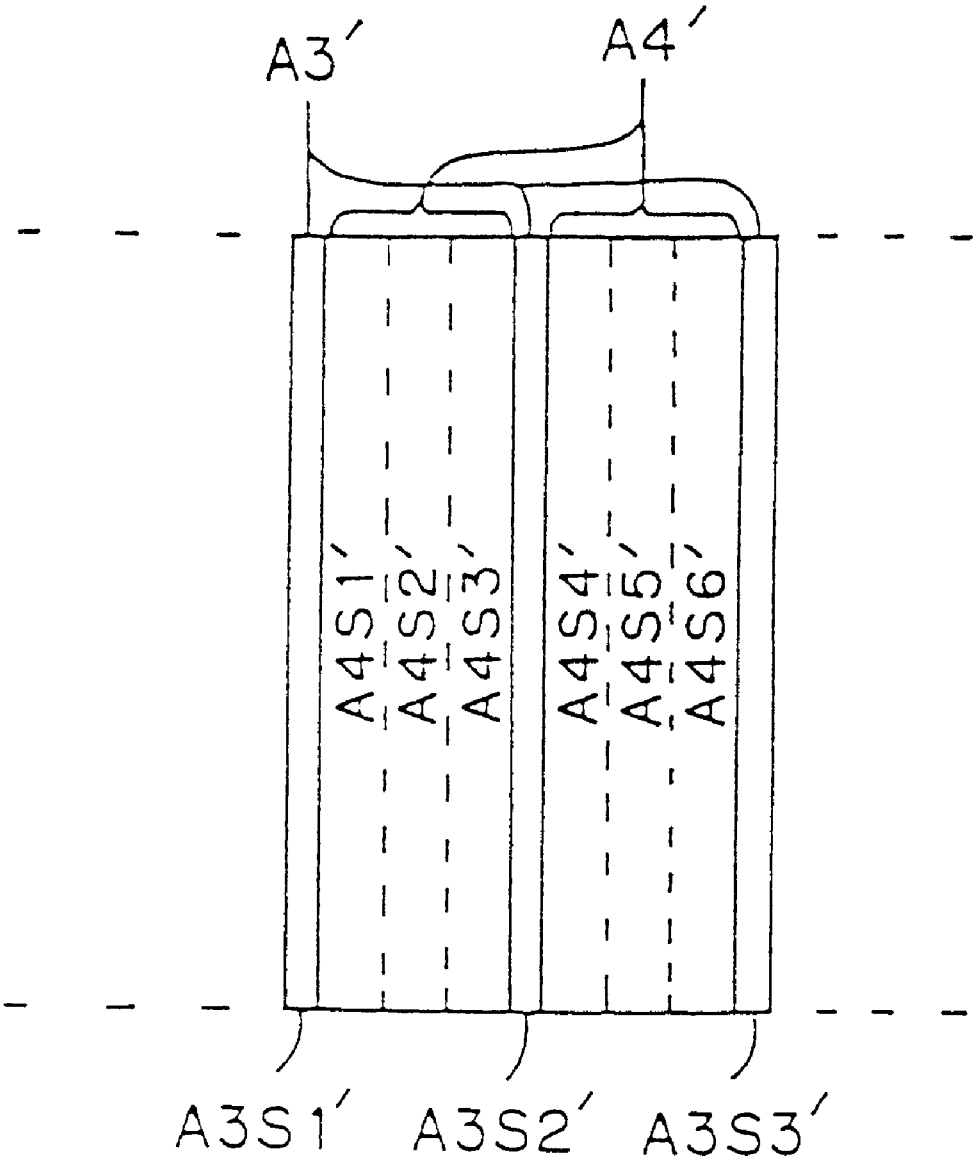
FIG. 12 is a diagram showing a modification of the dividing of a region in which the resistor array shown in FIG. 8 is arranged.

Referring now to FIG. 12, a modified averaging technique, relying on dividing a resistor positioned region into a plurality of areas will be described. In the foregoing embodiment, the matching of the resistors in the group RG5, i.e., the matching of the input resistors group RG3 (R10, R12) with the feedback/output resistor group RG4 (R13–R15) is achieved by arranging the area A4 with no separation in the area A3 which comprises separated subareas. However, if a higher degree of matching is desired between the resistor groups RG3 and RG4, the arrangement of the subareas of the two areas for the groups may be modified such that the subareas of the two areas are alternately positioned. As an example, the areas A3 and A4 may be arranged as A3' and A4' as shown in FIG. 12. More specifically, subareas A3S1'–A3S3' of the area A3' are all separated, and one half of subareas A4S1'–A4S6' of the area A4', i.e., A4S1'–A4S3' are placed between the subareas A3S1' and A3S2', and the remaining half of the subareas A4S1'14 A4S6', i.e., A4S4'–A4S6' are placed between the subareas A3S2' and A3S3'. The alternate arrangement as described above provides a higher degree of averaging between plural resistor groups.

Also, as an averaging technique relying on the assignment of stripes in respective subareas, the foregoing embodiment employs a "folded-back" assignment in which stripes are assigned to resistors in a "folded-back" manner. For example, in the subareas A1S1–A1S6, stripes are assigned to the resistors R1–R8 in the folded-back manner in the order of R8-R7- . . . -R2-R1-R2, . . . -R7 -R8-R8-R7, . . . , as can be seen from FIG. 3. This assinging method is advantageous since a pulrality of U-shaped first metal layer conductors 43*a* deposited as a single layer can be used to complete interconnections between stripes. However, for a higther degree of averaging effect, non-folded-back assignment may be used to assign stripes to resistors, for example, in the order of R8-R7 . . . , -R2-R1-R-R7, . . . , -R2-R1-8-R7, . . .

Further, while the foregoing embodiment employs series connections of elements or series connections of parallel connected elements as the patterns of electrical connections between stripes, any other patterns of electric connections may also be used.

Furthermore, in the foregoing embodiment, the circuit of the summing amplifier 3 employs two inverting buffers.

Alternatively, the summing amplifier 3 may be modified to be configured by using a differential instrumentation amplifier. Also, while a differential summing amplifier 3 is used in the foregoing embodiment because the DAC 1 itself is of a differential type, a non-differential summing amplifier may also be used for a non-differential DAC 1 or if required by particular applications. Further, the present invention may be applied to any other type of DACs including summing amplifiers. Even in such a case, resistor arrays according to the present invention, when used, will provide similar advantages as described above.

Furthermore, resistor arrays according to the present invention may be applied to any other analog integrated circuit, as long as the circuit has parameters which are influenced by the voltage dependency of resistors in the circuit. Examples of the circuit may be operational amplifiers and a variety of circuits including amplifiers. Also, the parameters of the circuit may include voltage gain, current gain, and any other parameter representing a circuit characteristic, for example, linearity.

Finally, in conclusion, in order to reduce variations in voltage dependency among a plurality of resistor stripes within the resistor array of the present invention, the following are important: a collective arrangement of the stripes in the same region, the same material is used for the stripes, and the stripes have the same cross-sectional area. To realize stripes having the same cross-sectional area, the stripes are preferably arranged to extend in the same direction and be closely spaced with each other. The closely spaced arrangement of the stripes is effective in minimizing changes in resistance of the respective stripes due to stress which would be applied to a chip when the chip is packaged. Also, stripes having the same length are effective in enhancing the averaging effect. To minimize variations in voltage dependency among a plurality of resistors, the closely spaced arrangement of resistors requiring a higher degree of matching and the averaging are effective. To reduce the voltage dependency of a certain parameter in an analog circuit, if a plurality of resistor groups are included therein, it is effective to position resistor groups requiring a higher degree of matching in close proximity to each other.

According to the present invention described above in detail, the voltage dependency of certain parameters in an analog integrated circuit can be reduced. Thus, the present invention provides advantages in improving the performance and accuracy of the analog integrated circuit.

What is claimed is:

1. An integrated circuit resistor array, comprising in combination:

(a) a single region on an integrated circuit chip;

(b) a plurality of individual elongated spaced resistive stripes distributed throughout the single region, all of the same thickness and width, each having a first end and a second end, a voltage dependency of each of the various resistive stripes being dependent on the location of that resistive stripe within the region;

(c) the single region being subdivided into a plurality of contiguous subregions, each subregion being further subdivided into a plurality of contiguous elongated non-overlapping subareas;

(d) each resistive stripe being contained in only one subarea, each subarea containing a plurality of the resistive stripes;

(e) a first group of metal conductors each connecting the first end of a resistive stripe, respectively, of a first group of the resistive stripes to the second end of another resistive stripe, respectively, of the first group to form a first resistor, at least some of the resistive stripes of the first group being distributed throughout a first subregion by being located in separate subareas, respectively, of the first subregion to thereby average variations in the voltage dependencies of the resistive stripes forming the first resistor;

(f) a second group of metal conductors each connecting the first end of one of the resistive stripes of a second group of the resistive stripes other than those of the first group to the second end of another of the resistive stripes of the second group to form a second resistor, at least some of the resistive stripes of the second group being distributed throughout the first subregion by being located in separate subareas of the first subregion to thereby average variations in the voltage dependencies of the resistive stripes forming the second resistor (g) various stripes of the first group thereby being close to various stripes of the second group to cause a voltage dependency of the first resistor to be matched to a voltage dependency of the second resistor.

2. The integrated circuit resistor array of claim 1 including first and second resistor groups, each of the first and second resistor groups including a plurality of resistors having resistance values matched with each other, each of the resistors including a plurality of the resistive stripes, the resistive stripes forming that resistor being located in a plurality of subareas, respectively, of a subregion.

3. The integrated circuit resistor array of claim 1 wherein the resistive stripes are equally spaced from one another.

4. The integrated circuit resistor array of claim 1 wherein the resistive stripes are rectangular and parallel to one another.

5. The integrated circuit resistor array of claim 1 wherein the single region is rectangular.

6. The integrated circuit resistor array of claim 1 wherein the voltage dependency of the first resistor and the voltage dependency of the second resistor are directly related to the widths of the resistive stripes of which the first and second resistors are composed, respectively.

7. The integrated circuit resistor array of claim 1 wherein the resistive stripes are of the same length.

8. The integrated circuit resistor array of claim 1 wherein the subregions are rectangular and the subareas are rectangular.

9. The integrated circuit resistor array of claim 8 including a subregion including a subarea which is not contiguous with any other subarea in that subregion.

10. The integrated circuit resistor array of claim 6 wherein the resistive stripes are composed of polycrystalline silicon.

11. An integrated circuit resistor array for use in a digital-to-analog circuit, comprising:

a first group of resistors of a converting resistor circuit;

a second group of resistors of an RC filter circuit;

a third group of resistors constituting input resistors of a differential buffer circuit;

a fourth group of resistors of the differential buffer circuit;

and a fifth group of resistors of the differential buffer circuit;

each of the first through the fifth groups of resistors being formed in the integrated circuit resistor array, the integrated circuit resistor array including (a) a single region on an integrated circuit chip;

(b) a plurality of individual elongated spaced resistive stripes distributed throughout the single region, all of the same thickness and width, each having a first end and a second end, a voltage dependency of each of the various resistive stripes being dependent on the location of that resistive stripe within the region;

(c) the single region being subdivided into a plurality of contiguous subregions, each subregion being further subdivided into a plurality of contiguous elongated non-overlapping subareas;

(d) each of the resistive stripes being located in only one subarea, each subarea containing a plurality of the resistive stripes;

(e) a first group of metal conductors each connecting the first end of a resistive stripe, respectively, of a first group of the resistive stripes to the second end of another resistive stripe, respectively, of the first group to form a first resistor, at least some of the resistive stripes of the first group being distributed throughout a first subregion by being located in separate subareas, respectively, of the first subregion to thereby average variations in the voltage dependencies of the resistive stripes forming the first resistor;

(f) a second group of metal conductors each connecting the first end of one of the resistive stripes of a second group of the resistive stripes other than those of the first group to the second end of another of the resistive stripes of the second group to form a second resistor, at least some of the resistive stripes of the second group being distributed throughout the first subregion by being located in separate subareas of the first subregion to thereby average variations in the voltage dependencies of the resistive stripes forming the second resistor;

(g) various stripes of the first group thereby being close to various stripes of the second group to cause a voltage dependency of the first resistor to be matched to a voltage dependency of the second resistor, the first resistor being included in a feedback resistance of the differential buffer circuit, the second resistor being included in an input resistance of the differential buffer circuit, the match of the voltage dependencies of the first resistor and the second resistor resulting in a differential buffer circuit gain which is substantially independent of the voltage dependencies of the first resistor and the second resistor.

12. The integrated circuit resistor array of claim 1 wherein the first group of metal conductors connect the resistive stripes of the first group in series to form the first resistor, and the second group of metal conductors connect the resistive stripes of the second group in series to form the second resistor.

13. An integrated circuit resistor array, comprising in combination:

(a) a single region on an integrated circuit chip;

(b) a plurality of individual elongated spaced resistive stripes distributed throughout the single region, all of the same thickness and width, each having a first end and a second end, a voltage dependency of each of the various resistive stripes being dependent on the location of that resistive stripe within the region;

(c) the single region being subdivided into a plurality of contiguous subregions, each subregion being further subdivided into a plurality of continguous elongated non-overlapping subareas;

(d) each resistive stripe being contained in only one subarea, each subarea containing a plurality of the resistive stripes;

(e) a first group of metal conductors each connecting the first end of a resistive stripe, respectively, of a first group of the resistive stripes to the second end of another resistive stripe, respectively, of the first group to form a first resistor, at least some of the resistive stripes of the first group being distributed throughout a first subregion by being located in separate subareas, respectively, of the first subregion to thereby average variations in the voltage dependencies of the resistive stripes forming the first resistor;

(f) a second group of metal conductors each connecting the first end of one of the resistive stripes of a second group of the resistive stripes other than those of the first group to the second end of another of the resistive stripes of the second group to form a second resistor, at least some of the resistive stripes of the second group being distributed throughout a second subregion by being located in separate subareas of the second subregion to thereby average variations in the voltage dependencies of the resistive stripes forming the second resistor;

(g) various tripes of the first group thereby being close to various stripes of the second group to cause a voltage dependency of the first resistor to be marched to a voltage dependency of the second resistor.

* * * * *